US005379922A

United States Patent [19]

Paradoski

[11] Patent Number: 5,379,922

[45] Date of Patent: Jan. 10, 1995

[54] TUBULAR CONTAINER WITH AN ADJUSTABLE OPENING

[76] Inventor: Ronald I. Paradoski, 808 Phyllis La., St. Louis, Mo. 63141

[21] Appl. No.: 113,620

[22] Filed: Aug. 27, 1993

[51] Int. Cl.[6] ..... B67D 5/32

[52] U.S. Cl. ..... 222/153; 222/522

[58] Field of Search ..... 222/153, 191.1, 191.2, 222/480, 482, 522, 559, 565; 215/256

[56] References Cited

U.S. PATENT DOCUMENTS

| | | | |
|---|---|---|---|
| 120,339 | 9/1871 | Spencer | 222/522 |
| 1,354,921 | 9/1920 | Sodhelm | 222/559 |
| 2,143,263 | 1/1939 | Fisher | 222/522 |
| 2,776,787 | 1/1957 | Nicol | 222/565 |
| 2,991,923 | 7/1961 | Wilson | 222/183 |
| 3,057,525 | 9/1962 | Malachick | 222/482 |
| 3,305,145 | 2/1967 | Tebbutt | 222/522 |
| 4,023,714 | 5/1977 | Klemek | 222/196.1 |
| 4,535,890 | 8/1985 | Artusi | 206/530 |
| 4,871,093 | 9/1989 | Burshtain et al. | 222/196.2 |
| 4,976,379 | 12/1990 | Sloan | 215/256 |
| 5,104,008 | 4/1992 | Crisci | 215/256 |
| 5,213,238 | 5/1993 | Martin et al. | 222/480 |

FOREIGN PATENT DOCUMENTS

| | | |
|---|---|---|
| 4886 | 2/1897 | United Kingdom . |
| 1226248 | 10/1969 | United Kingdom . |
| PCT/US86/-02642 | 12/1986 | WIPO . |

*Primary Examiner*—Andres Kashnikow
*Assistant Examiner*—Philippe Derakshani
*Attorney, Agent, or Firm*—Rogers, Howell & Haferkamp

[57] ABSTRACT

The present invention provides an inexpensive adjustable dispensing container having a tubular body with its opposite ends closed and with a side opening extending through the body to its interior volume. A collar is secured over the side opening to prevent the unintentional dispensing of the container's contents through the opening. A frangible connection maintains the collar in its closed position over the side opening and when broken enables the collar to be moved over the tubular body to adjustably open the side opening and permit dispensing of the container contents. The friction engagement of the collar on the tubular body maintains the collar in its adjusted position relative to the body side opening.

18 Claims, 1 Drawing Sheet

TUBULAR CONTAINER WITH AN ADJUSTABLE OPENING

BACKGROUND OF THE INVENTION (1) Field of the Invention

The present invention pertains to a container having a tubular body with closed opposite ends and a side opening through the body to its interior volume. A collar is mounted to the body for sliding movement between a pair of abutments also secured to the body. The sliding movement of the collar adjustably opens the body side opening for dispensing the contents of the container interior volume.

(2) Description of the Related Art

Various different types of containers are known in the prior art that are specifically designed to dispense the contents of the container by shaking the container. Examples of these types of prior art containers include containers employed in dispensing spices and other food condiments, and containers employed in dispensing cleansers such as kitchen and bathroom cleansers. Containers of this type generally have a tubular configuration with a closure member at one end of the tube.

Various types of closures members are employed with dispensing containers. Some prior art closure members provide the feature of adjusting the rate at which the contents of the container are dispensed from the container. These prior art closure members include rotatable closure members mounted at one end of the tubular container. The closure member is rotated in opposite directions to selectively open and close a dispensing opening of the container, and for adjusting the degree or size of the dispensing opening. The rotatable type of closure member is typically constructed of a plastic material and is attached to one end of the tubular container in a manner that enables the closure member to rotate relative to the container. The rotating closure member and its assembly to the tubular container often represent a substantial portion of the overall production costs of the container.

A more economical closure member used with dispensing containers is the type often used with kitchen and bathroom cleanser dispensing containers. These closure members are often comprised of an adhesive patch adhered over a plurality of openings at one end of the tubular container. The patch is pulled back to expose a desired number of the openings in the container end, and thereby adjust the dispensing rate of the contents of the container. To close the dispensing openings, the patch is again adhered to the area of the container end from which it had been peeled back. Although this form of closure member is less expensive to manufacture than the rotatable type of closure member, it is inconvenient to use because the contents of the container shaken through the dispensing openings often adhere to the adhesive backing of the peeled back patch.

SUMMARY OF THE INVENTION

The present invention provides an adjustable dispensing container that is manufactured inexpensively and is convenient to use in adjusting the rate at which the contents of the container are dispensed from the container. The container is basically comprised of a tubular body with closed opposite ends, and with a side opening extending through the body to its interior volume. A collar is mounted for sliding movement over the exterior surface of the body and the sliding movement of the collar is limited by a pair of abutments secured to the body.

In its initial configuration, the collar is secured against sliding movement over the body by a frangible connection between the collar and one of the pair of abutments. The frangible connection maintains the collar in a set position over the tubular body where it extends over the side opening and prevents the contents of the tubular body from being dispensed through the side opening. Breaking or removing of the frangible connection enables the collar to slide freely over the body between the pair of abutments. The extent to which the collar is moved from its position over the side opening adjustably opens the side opening for dispensing the container contents through the side opening at a desired rate.

In a variant embodiment a sealing patch is adhered over the side opening beneath the collar. On breaking the frangible connection and moving the collar from the side opening, the sealing patch is removed exposing the side opening for dispensing the container's contents.

The side opening may also be provided with two separate areas of the opening. A first area of the opening is comprised of a plurality of small apertures for shaking the container contents at a reduced rate. The second area of the opening is comprised of a single large aperture, much larger than the individual apertures of the first area of the side opening. The large aperture is employed in dispensing the contents of the container at a greater rate than the first area of the opening comprised of the plurality of smaller apertures.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

Figure 1:
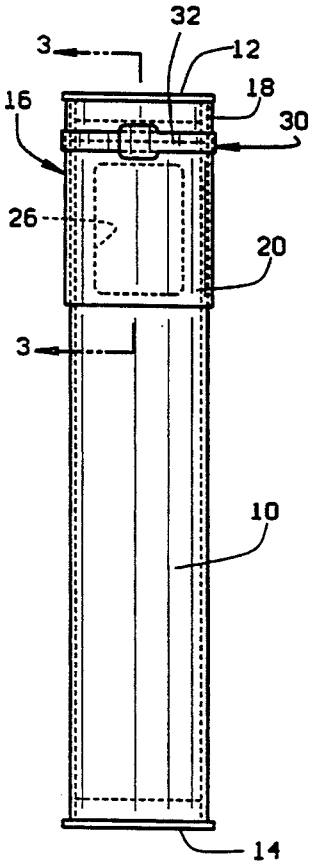
FIG. 1 is a front elevation view of the adjustable dispensing container of the present invention.
Figure 2:
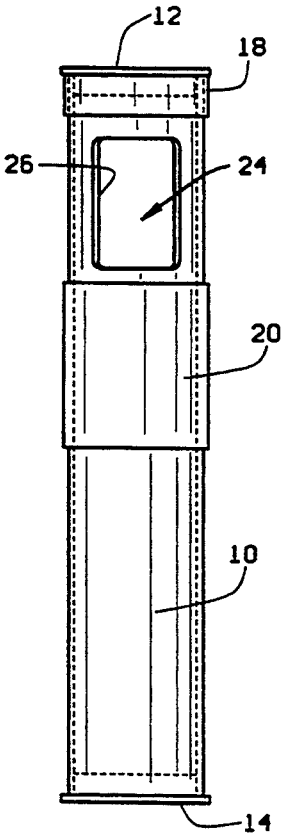
FIG. 2 is an elevation view similar to FIG. 1 showing displacement of the container collar.

The adjustable dispensing container 10 of the present invention is best seen in drawing FIGS. 1 and 2. Generally, the container is comprised of a tubular body 10, end caps 12 and 14, and a sleeve 16 having an abutment portion 18 and a collar portion 20.

The tubular body 10 may have a cross section of a circular or polygonal configuration. The only requirement of the tubular body configuration is that it be consistent along its axial length and that the collar 20 have a corresponding configuration enabling it to slide over the length of the body as will be explained. The tubular body may be constructed of a variety of different materials to best suit it for its intended use. The body may also be constructed of transparent materials to enable the viewing of the container's contents from outside the container. The relative dimensions of the component parts of the container shown in the drawing figures are illustrative only and the dimensions of the container may be varied to best suit it for its intended use.

The tubular body 10 has a hollow interior volume 24 extending through the entire axial length of the body. The axially opposite open ends of the tubular body are sealed closed by the pair of end caps 12, 14. A side opening 26 extends through the tubular body to its interior volume. The side opening 26 is the only access to the interior volume of the body.

Figure 3:
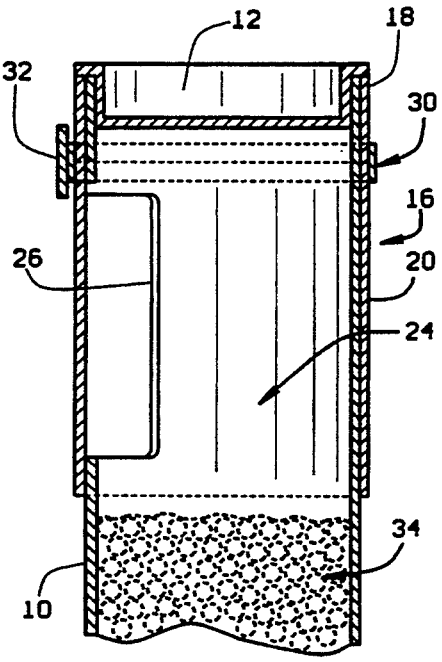
FIG. 3 is a partial side elevation view, in section, taken along the plane 3—3 of FIG. 1.

The sleeve 16 is given a configuration to match the general configuration of the tubular body 10. The sleeve is dimensioned to be received over the exterior surface of the tubular body in a tight friction engagement; however, still enabling the collar portion 20 of the sleeve to slide over the body as will be explained. In its initial configuration, the sleeve 16 is positioned on the tubular body with the sleeve abutment portion 18 adjacent one of the end caps 12 and the collar portion 20 extending over the body side opening 26. As seen in FIGS. 1 and 3, the axial length of the collar portion 20 is chosen so that it entirely covers over the body side opening 26. The sleeve abutment portion 18 is secured to the tubular body 10 by adhesives or other known means. The collar portion 20 is not adhered or otherwise secured to the exterior surface of the tubular body 10.

A frangible connection 30 maintains the sleeve collar portion 20 in engagement with the abutment portion 18. In the embodiment of drawing FIGS. 1–3 the sleeve collar portion 20 is separate from the abutment portion 18 and the frangible connection 30 is provided by an adhesive strip 32. The strip 32 is wrapped around the abutting engagement of the bottom edge of the sleeve abutment portion 18 and the top edge of the collar 20 as viewed in the drawing figures and securely maintains these two component parts in abutting engagement. Peeling the adhesive strip 32 from the sleeve 16 breaks the frangible connection between the sleeve abutment portion 18 and the collar 20, enabling the collar to be separated from the abutment portion.

With the frangible connection between the sleeve abutment portion 18 and collar 20 broken, the collar is free to slide over the exterior surface of the tubular body 10 between the sleeve abutment portion 18 and the bottom end cap 14 of the container which functions as the second abutment. Alternatively, a second abutment similar to the sleeve abutment 18 may be added to the body to limit the downward sliding movement of the collar. The sleeve abutment may also be removed from the body and both end caps could function as the abutments limiting the collar's sliding movement. In such an embodiment, the frangible connection would then be provided between the collar and the top end cap adjacent the side opening. As seen in FIG. 2, with the collar 20 moved downward over the tubular body 10 until it is completely past the side opening 26, the side opening 26 is completely opened for dispensing the container contents 34. By moving the collar 20 upward relative to its position on the tubular body 10 shown in FIG. 2, it may be adjustably positioned over the side opening 26, thereby adjusting the area of the side opening 26 through which the container contents 34 may be dispensed. The friction engagement of the collar on the body maintains the collar in its adjusted position relative to the body side opening. In this manner, the collar 20 is used both to open and close the side opening 26 of the container, and to adjust the area of the side opening to adjust the rate at which the container contents 34 may be dispensed from the container.

Various different types of frangible connections may be employed with the dispensing container of the invention other than the adhesive strip 30 referred to above. For example, a line of perforations extending around the sleeve between the abutment portion and collar portion of the sleeve may serve as the frangible connection. Twisting the collar portion of the sleeve relative to the abutment portion will cause the frangible connection provided by the line of perforations to break, thereby separating the collar from the abutment portion. With the collar separated from the abutment portion, it is free to be adjustably positioned over the side opening for adjusting the dispensing rate of the container contents in the manner described above.

Figure 4:
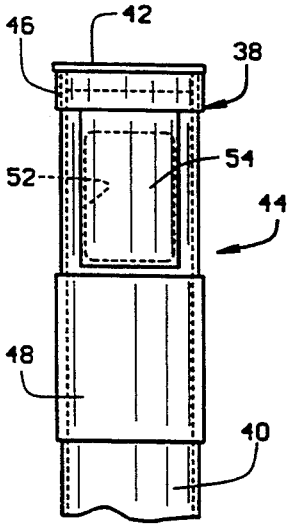
FIGS. 4–6 show variant embodiments of the side opening of the adjustable dispensing container of the present invention.
Figure 5:
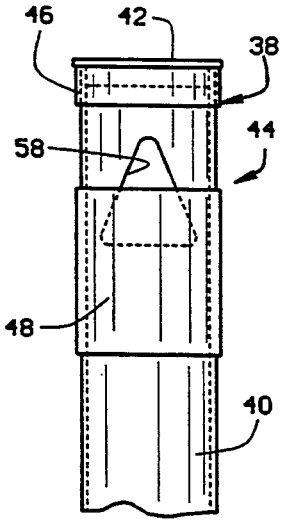
Figure 6:
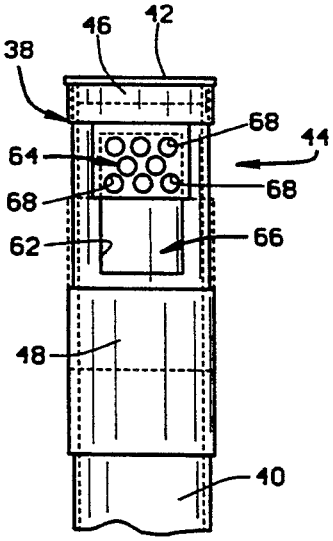

FIGS. 4–6 show the alternate embodiment of the invention wherein the frangible connection is provided by a line of perforations extending around the sleeve and separating the sleeve abutment portion from the sleeve collar portion. Also shown in FIGS. 4–6 are variant embodiments of the side opening of the container. In each of the three embodiments shown in FIGS. 4–6 the tubular body 40, the end cap 42, the sleeve 44 with its abutment portion 46 and collar portion 48 are all the same and are identified by the same reference numbers. These three embodiments differ only in the construction of their side openings.

FIG. 4 shows the dispensing container of the invention having a side opening 52 substantially identical to that described with referenced to FIGS. 1 and 3 above. However, a sealing patch 54 has been adhered to the tubular body 10 over the side opening 52. The sealing patch 54 is adhered to the tubular body 40 around the periphery of the side opening 52 and seals the side opening closed. In the initial configuration of the container, the patch 54 is covered over by the collar 48 and is not exposed until the frangible connection 38 is broken and the collar 48 is moved downward over the tubular body to expose the patch. With the patch exposed, it is then peeled back from the tubular body 40 exposing the side opening 52 for dispensing the contents of the container.

The side opening 58 of the container shown in FIG. 5 has a general triangular configuration. With the apex of the side opening 58 positioned adjacent the sleeve abutment 46, it should be appreciated that this configuration of the side opening enables the dispensing rate of the container to be adjusted to a very small rate by positioning the collar 48 toward the opening's apex. By adjustably positioning the collar 48 away from the apex the dispensing rate of the container is quickly increased.

The side opening 62 of the container embodiment of FIG. 6 has two separate opening areas 64, 66. The first opening area 64 is defined by a plurality of small apertures 68 through a patch that is permanently secured over the upper half of the side opening 62. Although a patch with the apertures 68 is shown secured to the tubular body 40, it should be understood that the patch could be done away with entirely and the plurality of small apertures 68 could be provided directly through the material of the tubular body in the area of this patch.

The second opening area 66 is provided by the lower half of the side openings 62 not covered by the patch with the apertures. This second area 66 provides a much larger opening than the individual apertures 68 for dispensing the container contents.

By adjustably positioning the collar 48 upward on the body over the second opening area 66 as shown in dashed lines in FIG. 6, the dispensing of contents of the container occurs only through the plurality of smaller apertures 68, thereby reducing the rate at which the container contents may be dispensed. By moving the collar 48 downward over the tubular body, the second opening area 66 of the side opening is exposed, enabling the container contents to be dispensed at a much greater rate.

While the present invention has been described by reference to specific embodiments, it should be understood that modifications and variations of the invention may be constructed without departing from the scope of the invention defined in the following claims.

What is claimed is:

1. A container with an adjustable opening for dispensing contents of an interior volume of the container, the container comprising:

a tubular body having an axial length and a hollow interior volume extending through its axial length, the body having closed axially opposite ends and at least one side opening through the body to the interior volume;

a collar mounted on the tubular body for sliding movement of the collar axially over the body between the body opposite ends, the collar having an axial length that causes the collar to cover over the side opening when the collar is moved to a position on the body overlapping the side opening and adjacent one end of the body; and a frangible connection provided between the collar and the one end for maintaining the collar in position over the side opening until the connection is broken, and the collar being free to slide axially over the tubular body between the body opposite ends once the frangible connection is broken.

2. The container of claim 1, wherein:

the frangible connection is provided by a line of perforations that extend around the collar between the collar and the one end.

3. The container of claim 1, wherein:

the frangible connection is provided by a strip removably adhered around the collar and the one end.

4. The container of claim 1, wherein:

the collar is part of a sleeve secured to the body adjacent the one body end and extending axially over the side opening in the body, the frangible connection extends around the sleeve and separates the sleeve into two parts, a first part of the sleeve forms an abutment when the frangible connection is broken and a second part of the sleeve forms the collar when the frangible connection is broken.

5. The container of claim 1, wherein:

a sealing patch is removably secured over the side opening of the tubular body, and the collar slides over the sealing patch as it slides over the body between the opposite body ends.

6. The container of claim 1, wherein:

the side opening has at least two different opening areas, a first opening area of the side opening is comprised of a plurality of small apertures through the tubular body, and a second opening area of the side opening is comprised of a single large aperture through the tubular body, the large aperture having a larger opening area than a small aperture of the plurality of small apertures.

7. The container of claim 1, wherein:

the tubular body is constructed of a material that enables viewing of contents of the body interior volume through the body.

8. The container of claim 1, wherein:

the tubular body has a circular cross section.

9. The container of claim 1, wherein:

the tubular body has a polygonal cross section.

10. The container of claim 1, wherein:

a pair of axially spaced abutments are provided on the container body where the pair of abutments limit the sliding movement of the collar over the body to between the pair of abutments.

11. A container with an adjustable opening for dispensing contents of an interior volume of the container, the container comprising:

a tubular body having an axial length and a hollow interior volume extending through its axial length, the body having axially opposite closed ends and at least one side opening through the tubular body adjacent one of the opposite ends;

a pair of abutments secured to the tubular body adjacent the opposite ends, one abutment being secured adjacent the side opening and the one of the opposite ends;

a collar mounted on the tubular body for sliding movement of the collar over the tubular body between the pair of abutments, the pair of abutments and the collar being dimensioned to limit the sliding movement of the collar over the body to sliding movement between the pair of abutments, and the collar having an axial dimension that causes the collar to cover over the side opening of the tubular body with the collar moved into abutting engagement with the one abutment; and, a frangible connection between the collar and the one abutment that maintains the collar in engagement with the one abutment until the frangible connection is broken, whereby the collar is free to slid axially over the tubular body between the pair of abutments when the frangible connection is broken.

12. The container of claim 11, wherein:

a sealing patch is removably adhered over the side opening between the body and the collar.

13. The container of claim 11, wherein:

the side opening has at least two separate opening areas, a first opening area being comprised of a plurality of apertures through the tubular body and a second opening area being comprised of a single large opening through the tubular body.

14. The container of claim 11, wherein:

the pair of abutments are integral parts of the pair of end caps secured to the body over the opposite end openings.

15. The container of claim 11, wherein:

the collar is part of a sleeve secured to the tubular body adjacent the one of the opposite ends of the body, the frangible connection extends around the sleeve and separates the sleeve into two parts, a first part of the sleeve forms the one abutment when the frangible connection is broken and a second part of the sleeve forms the collar when the frangible connection is broken.

16. The container of claim 11, wherein:

the frangible connection is provided by a line of perforations that extend around the collar between the collar and the one abutment.

17. The container of claim 11, wherein:

the frangible connection is provided by a strip removably adhered around the engagement of the collar with the one abutment.

18. The container of claim 11, wherein:

the tubular body is constructed of material that enables viewing of contents of the body interior volume from outside the body interior volume.

* * * * *